United States Patent [19]

Shaw

[11] Patent Number: 5,076,428

[45] Date of Patent: Dec. 31, 1991

[54] TOOTHBRUSH TRAVEL CASE

[76] Inventor: John Shaw, 33 Laing Blvd., St. Thomas, Ontario, Canada, N5P 3Z4

[21] Appl. No.: 684,059

[22] Filed: Apr. 11, 1991

[51] Int. Cl.[5] ..... B65D 37/00

[52] U.S. Cl. ..... 206/362.2; 220/8

[58] Field of Search ..... 206/362.2, 362.1; 220/8

[56] References Cited

U.S. PATENT DOCUMENTS

| | | | |
|---|---|---|---|
| 2,718,980 | 9/1955 | Strom | 220/8 X |
| 2,719,626 | 1/1952 | Lermer | 206/362.2 |
| 2,815,057 | 3/1955 | Tupper | 206/362.2 X |
| 3,494,499 | 2/1970 | Plog et al. | 220/8 |
| 3,744,687 | 7/1973 | Oreck | 220/8 X |

*Primary Examiner*—William I. Price

*Attorney, Agent, or Firm*—Laurence R. Brown

[57] ABSTRACT

A toothbrush case serving both as an original package case and as a permanent storage-travel case has female and male body members with thin resilient PVC plastic walls that overlap at a detented region for manual engagement and disengagement. The case body members are in a preferred embodiment hollow receptacles defined by four quadrilateral walls and an end wall, with the male member funnelled for ready insertion into the female member. Detent dimples in two opposing side walls provide a snap-lock position in a region where the two body members overlap so that they may be manually engaged and disengaged by means of the resiliency characteristic of the walls. This resiliency absorbs impacts and shocks encountered in storage and assures long life without malfunctioning or breaking.

5 Claims, 2 Drawing Sheets

TOOTHBRUSH TRAVEL CASE

FIELD OF THE INVENTION

This invention relates to toothbrush containers and more particularly it relates to original packing containers which are suitable for long life use as a toothbrush travel case.

BACKGROUND ART

Conventionally new toothbrushes are packaged in very thin walled rigid plastic transparent cases which are discarded after opening. Such cases are not suitable for later storage use as travel cases, or the like, because they are of rigid plastic materials that are easily broken on impact. Furthermore original packaging cases are not constructed with carefully controlled dimensions or mating structure that serves to reliably contain toothbrushes in storage. When stored, the travel cases may be impacted by other items such as glass bottles with significant forces tending to shatter the thin rigid plastic casings.

While there have been dual purpose cases serving both as original packages and later storage holders for toothbrushes, they have had deficiencies that for example prevented them from reliably storing toothbrushes in a sanitary manner. If for example the cases are not tightly closed, the toothbrush may be subjected to entry of dirt, grime or germs. Also they may be stored under conditions that are not sanitary.

In U.S. Pat. No. 2,719,626 to H. B. Lermer, the "permanent" storage case provided would not serve well in a travel case environment where subjected to stresses and forces that could remove the lid or cover portion of the case and thus lose the ability to serve as a sanitary sanctuary for the toothbrush.

The same deficiency is even more pronounced in U.S. Pat. No. 2,815,057 to E. S. Tupper wherein the lid has structure particularly susceptible to encountering removal forces in a travel case environment, for example. Furthermore this case is hermetically sealed, and thus is not well adapted to occasional use and storage as a travel case. If a toothbrush is stored in damp condition in a hermetically sealed compartment as here provided, it can encourage growth of bacteria.

It is therefore an objective of this invention to provide an improved case which can serve both as an original case and thereafter as a permanent travel case particularly adapted for occasional use and storage with other articles that may exert forces tending to crush the case or to disengage a closure lid portion of a storage case.

DISCLOSURE OF THE INVENTION

This invention therefore provides an original toothbrush case with a structure that is well adapted for use as a permanent long-life sanitary storage compartment for a toothbrush which can survive the forces and conditions encountered in a travel case, for example.

In a preferred embodiment the toothbrush case is configured into two mating semi-enclosure bodies each having four quadrilateral walls and an end wall defining a toothbrush receiving receptacle portion. The two bodies respectively have mating female and male portions that overlap in mating position to form a single closed toothbrush storage compartment. Detent dimples are formed in two opposing sidewalls for snap-locking the two portions together and resisting reopening without exertion of manual force to undetent the two portions.

The case is made of thin plastic walls, preferably PVC, that resiliently give under impact and pressure, and which therefore function in the detenting mode to permit the detent dimples to interlock and disengage. The overlapped closure portion of the case snugly fits and mating is encouraged by means of funnelled entry edges on a male member that resides within a female member. However the fitting breathes and allows moisture that may be entrapped in the toothbrush when stored to egress and permit the toothbrush to dry out so that it does not encourage growth of bacteria or other unsanitary conditions.

Other objects, features and advantages of the invention will be found throughout the following description, drawings and claims.

BRIEF DESCRIPTION OF THE DRAWINGS

In the accompanying drawings, wherein like reference characters are used to indicate similar features to facilitate comparison.

THE PREFERRED EMBODIMENT

Figure 1:
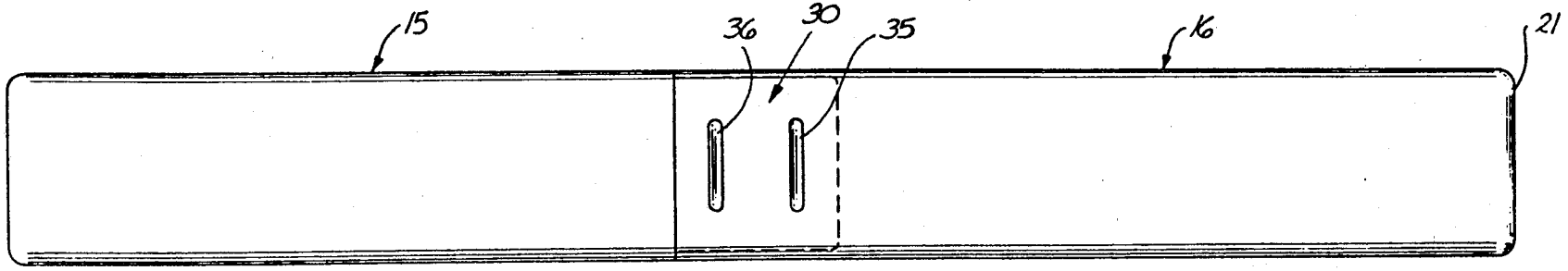
FIG. 1 is a top view of a toothbrush case affored by this invention in mated position.

As may be seen from the various views of the drawing, the toothbrush case, into which a toothbrush (not shown) fits, has two hollow body portions 15, 16, each defined by four quadrilaterally disposed sidewalls 17, 18, 19, 20 and an end wall 21. The case material is a resilient non-brittle plastic, preferably PVC, with a wall thickness typically 0.018 in. (0.5 cm). With all corners and edges rounded (25), and with the typical dimensions for holding a toothbrush, the resilient plastic provides a long lasting case that withstands significant external force without breaking or denting.

Furthermore the resilient plastic sidewalls are functionally significant in the mating together of the male body member 15 into the female body member 16 to form a snug fit, but one that will permit breathing and the egress of moisture. Thus, if a toothbrush is used and stored damp, it can dry out and provides better sanitary protection because of the tendency of bacteria to grow in a moist atmosphere.

Figure 2:
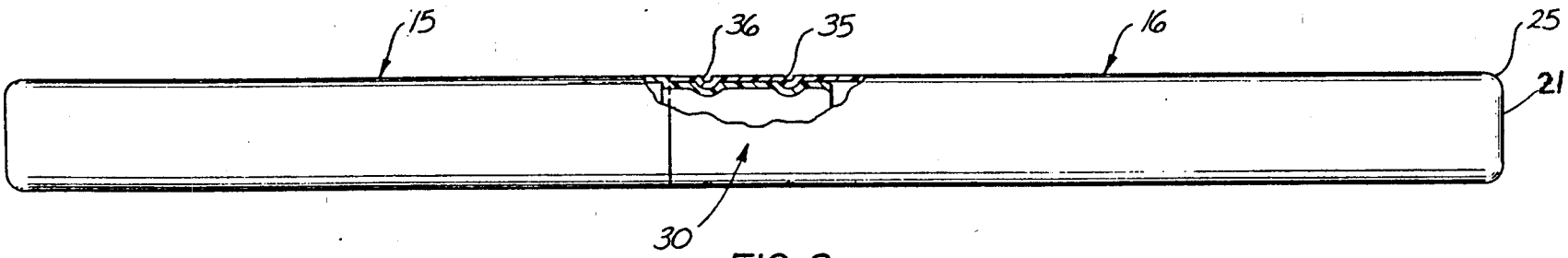
FIG. 2 is a side view partly broken away of the toothbrush case accenting the detent structure.
Figure 4:
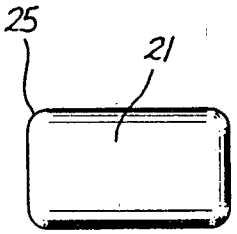
FIG. 4 is an end view of the case.
Figure 3:
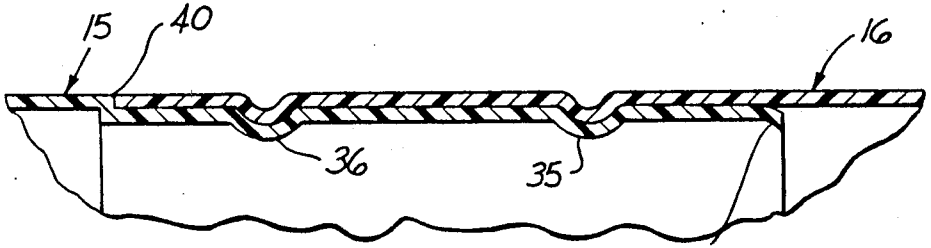
FIG. 3 is an enlarged view of the detent structure details.
Figure 5:
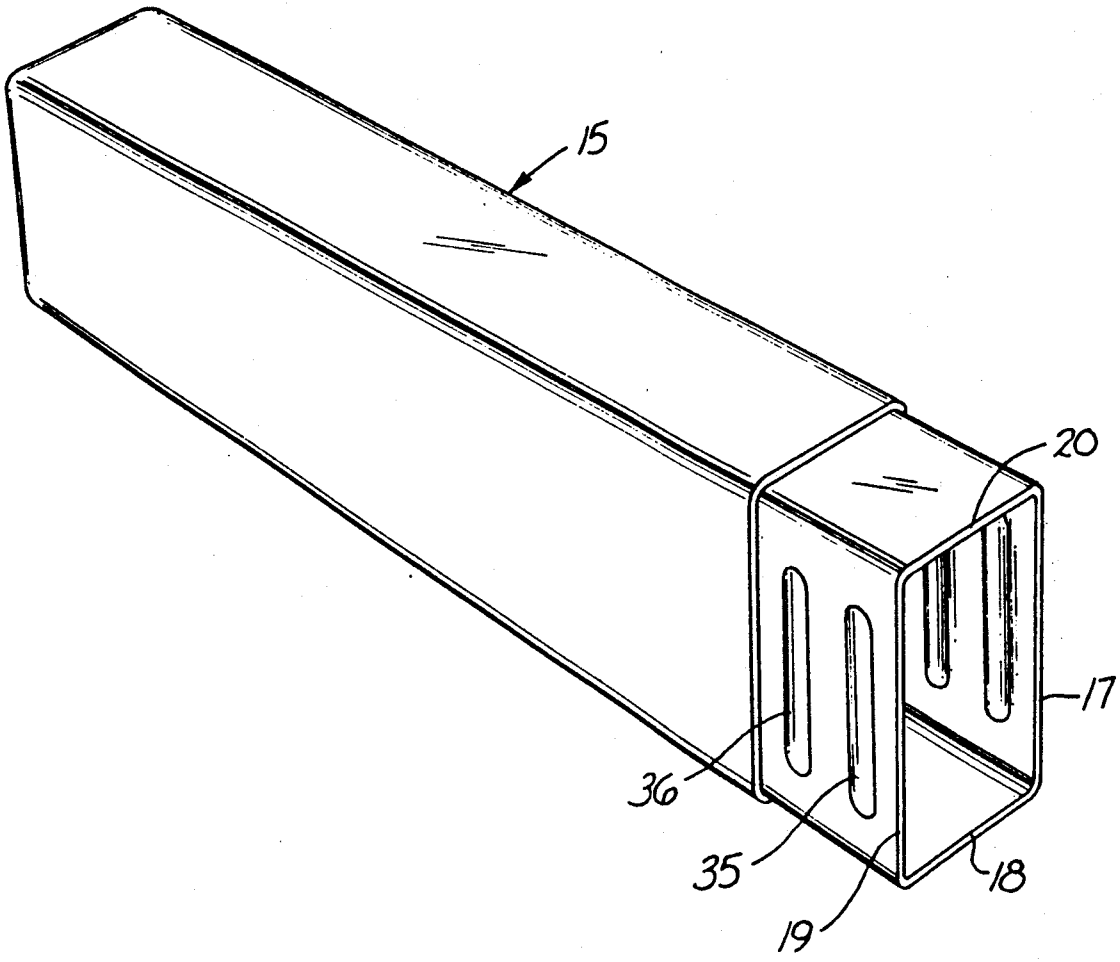
FIG. 5 is a perspective view of the male body portion of the toothbrush case.

Particularly critical is the detenting action in the overlap region, which relies upon the resiliency of the plastic case for producing a snap-lock detent action which reliably holds the two body portions in mated condition or storage of toothbrushes until the two body portions are forced apart manually. Note that there are no parts extending from the relatively smooth walls in the mated position of FIGS. 1 to 3 that might receive forces for accidentally disengaging the detent. Thus, this structure is ideally suited as a permanent travel case for a toothbrush that may be stored in a crowded travel kit and resist deformation by crushing. This case is adapted to receive various impacts and forces from bottles and compression, etc. without breaking or denting. There is little chance that the two body portions will come apart and endanger the sanitary conditions in which a toothbrush is stored.

The detent structure resides on the overlapping portion 30 of the two mated body portions 15, 16, and comprises a ribbed indentation formed by a pair of spaced dimples 35, 36 formed in opposing sidewalls 17, 19 of both body portions. The mating position is best seen from FIG. 3, where the outer female body portion 16 has flush outer walls fitting together with the outer walls of the male portion 15 at the joint 40. Thus, there is no tendency with the snug male-female fit for the two mated body portions to become axially misaligned. The detent portions are mated frictionally and resiliently as they are deformed under manual pressure as a function of the resiliency of the plastic case material.

The leading edges 45 of the male member to be inserted are chamfered to funnel the male member into the female member when mating. This avoids any criticality of closing the case which would otherwise be encountered with the snug fit provided. The snug but not hermetically sealed fit is critical to keep out dirt, grime or other contaminants, and to permit some breathing to encourage egress of any moisture vapors.

It is therefore seen that this invention provides novel and improved structure and function in a toothbrush case that may be used in the dual role of original packing case and permanent travel-storage case. Those features of novelty setting forth the spirit and nature of the invention are defined with particularity in the following claims.

I claim:

1. A long life reusable case for a toothbrush, comprising in combination, two case body portions each having thin resilient non-brittle plastic walls, said two body portions adapted to mate together to provide a closed compartment of a dimension for holding a resident toothbrush in a storage position within the mated body portions, case body dimensions disposing said walls in a configuration resistant to deformation by crushing in the presence of adjacent objects such as encountered in a travel case, and mating regions on the two body portions dimensioned for receiving a first male body portion within a second female body portion to produce said closed compartment with a joint that permits egress of vapor, with resiliently deformable complementing detent structure on both overlapping body portions that are manually engageable and disengageable in mating detented position in response to resiliency of the walls.

2. A case as defined in claim 1 wherein each body portion comprises a hollow member defined by four quadrilaterally disposed sidewalls and an end wall of said resilient plastic.

3. A case as defined in claim 2 wherein said plastic walls are polyvinylchloride.

4. A case as defined in claim 2 wherein said detent structure comprises ribbed indentations in two opposed ones of the sidewalls in each body portion.

5. A case as defined in claim 2 wherein the male body portion to be received within the female body portion has funnelled leading engagement edges for funnelling the male portion into the female portion.

* * * * *